US009848742B2

(12) United States Patent
Phillips

(10) Patent No.: US 9,848,742 B2
(45) Date of Patent: Dec. 26, 2017

(54) LEVEL ENTRY SHOWER SYSTEM

(71) Applicant: Gary R. Phillips, Raleigh, NC (US)

(72) Inventor: Gary R. Phillips, Raleigh, NC (US)

( * ) Notice: Subject to any disclaimer, the term of this patent is extended or adjusted under 35 U.S.C. 154(b) by 79 days.

(21) Appl. No.: 14/776,951

(22) PCT Filed: Mar. 14, 2014

(86) PCT No.: PCT/US2014/028645
§ 371 (c)(1),
(2) Date: Sep. 15, 2015

(87) PCT Pub. No.: WO2014/144298
PCT Pub. Date: Sep. 18, 2014

(65) Prior Publication Data

US 2016/0029853 A1 Feb. 4, 2016

Related U.S. Application Data

(60) Provisional application No. 61/792,428, filed on Mar. 15, 2013.

(51) Int. Cl.

| | |
|---|---|
| ***A47K 3/40*** | (2006.01) |
| ***E03F 5/04*** | (2006.01) |
| ***B25B 13/02*** | (2006.01) |
| ***B25B 13/48*** | (2006.01) |

(52) U.S. Cl.
CPC ..... *A47K 3/405* (2013.01); *B25B 13/02* (2013.01); *B25B 13/48* (2013.01); *E03F 5/0408* (2013.01)

(58) Field of Classification Search
CPC ..... E03F 5/0408; A47K 3/40; A47K 3/405
See application file for complete search history.

(56) References Cited

U.S. PATENT DOCUMENTS

| | | | | |
|---|---|---|---|---|
| 3,462,771 | A | 8/1969 | Moretti | |
| 4,146,939 | A * | 4/1979 | Izzi | E03C 1/26 4/286 |
| 4,694,513 | A * | 9/1987 | Kiziah | E03F 5/0408 285/136.1 |
| 5,103,698 | A | 4/1992 | Delaney | |
| 5,718,008 | A | 2/1998 | Pane | |
| 6,276,242 | B1 | 8/2001 | Wiggins et al. | |
| 6,725,470 | B2 | 4/2004 | Webb | |

(Continued)

OTHER PUBLICATIONS

International search report, international application No. PCT/US14/28645. dated Aug. 21, 2014. Korean Intellectual Property Office, Daejeon Metropolitan City, KR.

(Continued)

*Primary Examiner* — J. Casimer Jacyna
(74) *Attorney, Agent, or Firm* — Olive & Olive, P.A.

(57) ABSTRACT

Providing an easy to install shower tray and drain assembly. The tray comprises a stepped upper surface and a receptor having at least one step for receiving the drain assembly. In certain embodiments, the drain assembly comprises a cup for securing the drain assembly to the receptor and to a drainage pipe, a clamping flange for securing a waterproof floor covering between itself and the cup, at least one seal for providing a watertight seal between the clamping flange and cup. The drain assembly may further comprise a grate, a grate retainer, and an adjuster for adjustably securing the grate retainer to the clamping flange.

13 Claims, 7 Drawing Sheets

(56) References Cited

U.S. PATENT DOCUMENTS

| | | | | |
|---|---|---|---|---|
| 6,890,427 | B2 | 5/2005 | Self et al. | |
| D539,394 | S | 3/2007 | Luxton | |
| 7,694,358 | B2 | 4/2010 | Stimpson | |
| 7,900,294 | B2 | 3/2011 | Luxton et al. | |
| 8,043,497 | B2 * | 10/2011 | Silverstein | E03F 5/0407 210/164 |
| 9,175,464 | B2 * | 11/2015 | Meyers | E03F 5/0408 |
| 2005/0081290 | A1 | 4/2005 | Stimpson | |
| 2010/0083439 | A1 | 4/2010 | Stimpson | |
| 2010/0146699 | A1 | 6/2010 | Stimpson | |
| 2011/0088160 | A1 * | 4/2011 | Stimpson | A47K 3/40 4/613 |
| 2011/0088161 | A1 | 4/2011 | Stimpson | |
| 2011/0203979 | A1 * | 8/2011 | Schlueter | E03F 5/04 210/164 |
| 2013/0061388 | A1 | 3/2013 | Lebrun | |

OTHER PUBLICATIONS

Barrier free showering & bathroom safety accessories. AKW-Medicare Barrier-Free Solutions. 2009. Catalog. 40 pages. DLP Limited, Isle of Man, UK.

AKW Features and Benefits Sheets. 6 pages. 2011. AKW-Medicare. DLP Limited, Isle of Man, UK.

Tuff-form wet floor former fitting instructions. 5 pages. 2010. AKW-Medicare. DLP Limited, Isle of Man, UK.

Install a Tuff-Form: A Step by Step Joist Installation. 7 pages. 2011. www.arc-first.net. Accessibility Resource Center, Inc.

* cited by examiner

Fig. 4
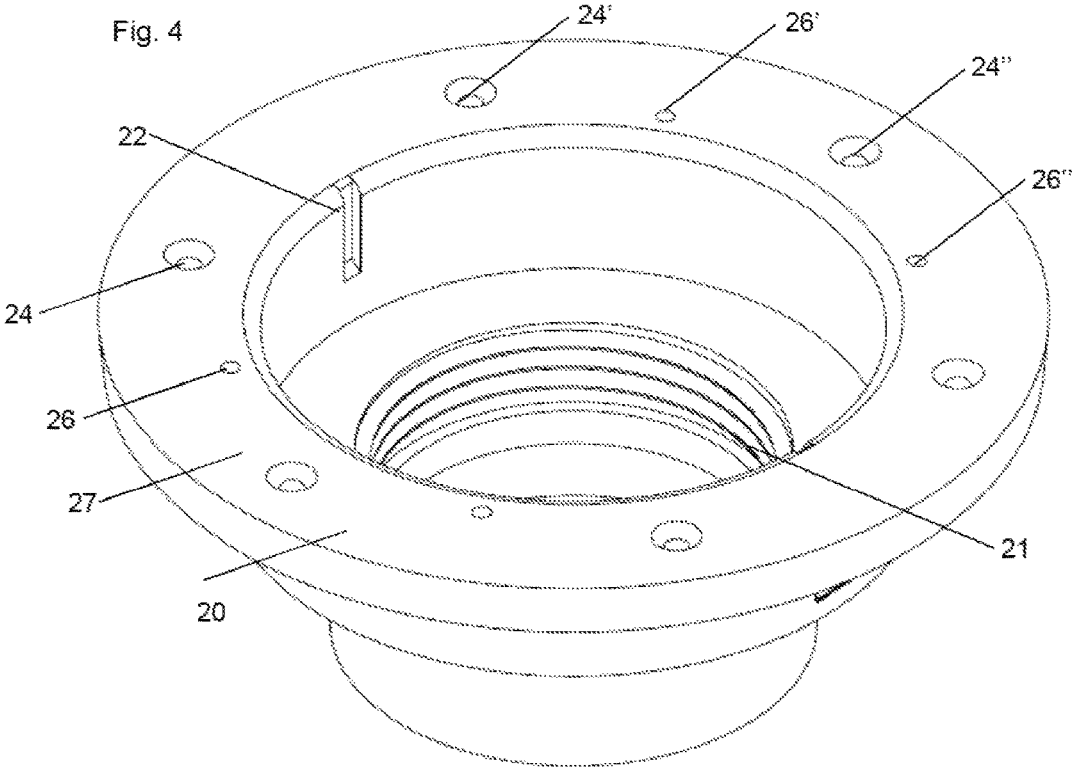
Fig. 5
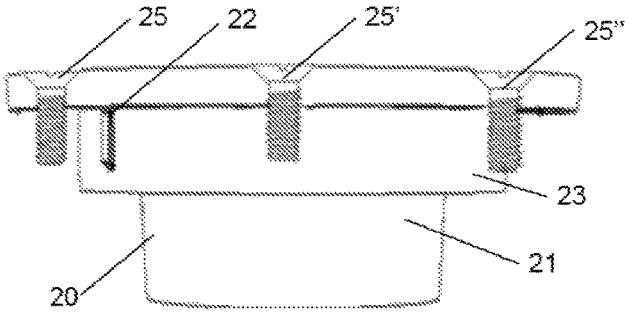
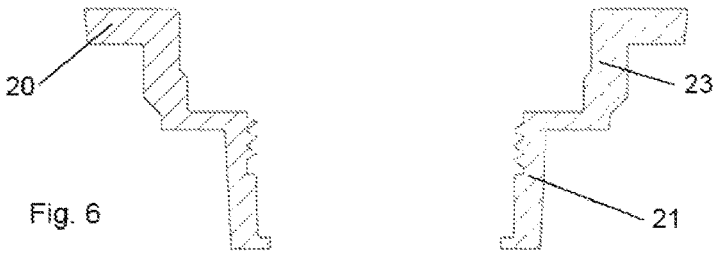
Fig. 6

LEVEL ENTRY SHOWER SYSTEM

BACKGROUND OF THE INVENTION

This invention relates to a shower system having a level entry.

Level entry showers are well-known. They are a necessity for many disabled people and a luxury fixture for others. Generally, shower trays either incorporate a ramp into the design or are recessed into the floor such that a wheelchair or bath chair within the showering area is essentially level with the adjacent floor surface.

It has previously been proposed to provide a shower tray for a disabled person that has a tray and a removable cover plate supported above the tray on which the wheelchair stands during showering. Run-off water passes through holes in the cover plate and is conducted towards a waste water outlet by the tray. This is not ideal due to the size, strength, and durability required for the cover plate, making the cover plate heavy and thus difficult to remove for cleaning the tray.

Other shower trays for level entry showers incorporate a raised central portion and a wastewater channel for directing the runoff to a drain. These may be difficult to properly clean and also potentially difficult to install due to the location of the drain toward the outside edge of the shower tray. Still other shower trays comprise curbs around the exterior of the tray, which increases the difficulty and expense of installation as ramps have to be incorporated. Shower trays having no curb or barrier on the entry side are also known, but those often do not provide sufficient slope to ensure proper drainage without the use of some other means to prevent the wastewater from escaping the area.

Additionally, there have been a number of installation issues in the currently known drain assemblies for level entry shower systems. These systems comprise parts that are difficult to correctly install or require the investment of a significant amount of time for installation.

Those offering the sale and/or installation of known systems generally must stock several different shower pan sizes in order to accommodate the wide range of shower sizes.

Embodiments of the present invention seek to overcome some or all of these problems by providing a curbless, stepped shower tray appropriate for a wide range of shower sizes and an easy to install drain assembly.

SUMMARY OF THE INVENTION

Embodiments of the inventive shower system provide for a level entry with no curb to step over to enter the showering area. They incorporate certain design improvements over other systems for streamlined and improved installation. Several embodiments of the system comprise a shower tray and drain assembly. The tray comprises a stepped upper surface and a receptor having at least one step for receiving the drain assembly. In certain embodiments, the drain assembly comprises a cup for securing the drain assembly to the receptor and to a drainage pipe, a clamping flange for securing a waterproof floor covering between the clamping flange and the cup, at least one gasket for providing a watertight seal between the drainage pipe and cup. The drain assembly may further comprise a grate, a grate retainer, and an adjuster for adjustably securing the grate retainer to the clamping flange.

BRIEF DESCRIPTION OF THE DRAWINGS

FIG. 4 shows a perspective view of an embodiment of a drain assembly cup.

FIG. 5 shows a side view of the cup depicted in FIG. 4.

FIG. 6 is a cutaway side view of the cup depicted in FIG. 4.

DETAILED DESCRIPTION OF THE DRAWINGS

The inventive level entry shower system is described below with respect to non-exclusive embodiments depicted in the figures. The depicted embodiments of the inventive level entry shower system comprise a shower tray 10 and a drain assembly 100.

A. Shower Tray

Figure 1:
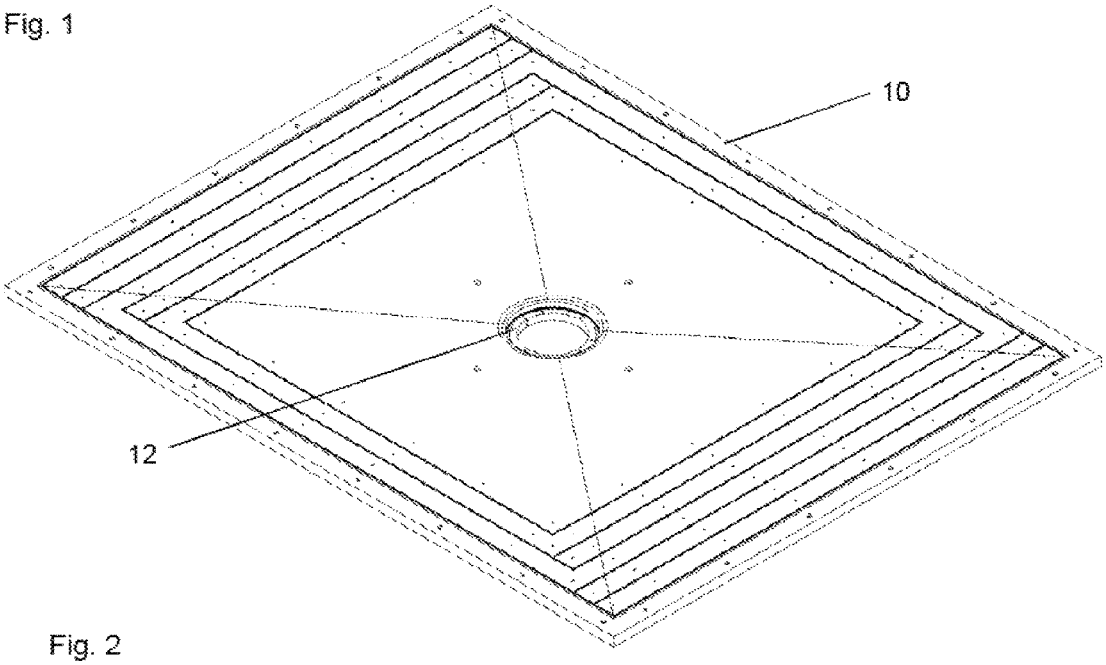
FIG. 1 depicts a top perspective view of an embodiment of a shower tray.
Figure 2:
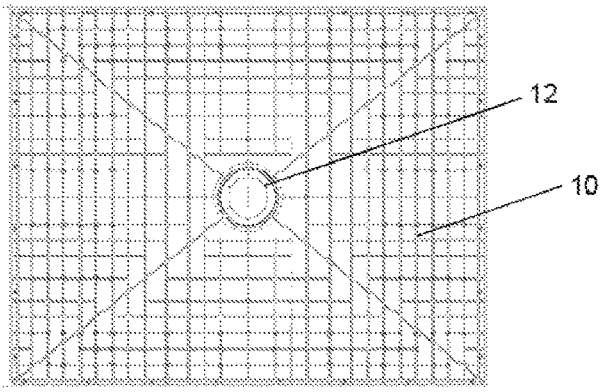
FIG. 2 depicts a bottom view of the shower tray embodiment shown in FIG. 1.
Figure 3:
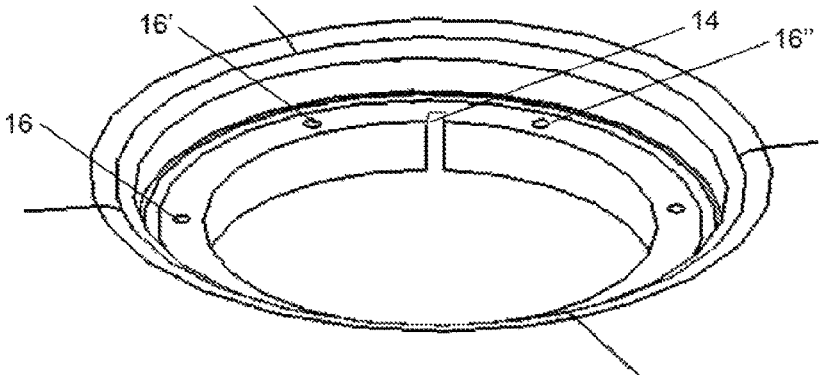
FIG. 3 provides a perspective close view of an embodiment of the receptor.

The shower tray 10, as depicted in FIGS. 1-3, comprises a top side having a plurality of steps, an underside having a waffle grid, and a receptor 12. The stepped design of the top side of the tray 10 should provide for a slope to meet local requirements from the exterior edge to a center drain opening (e.g., 2% slope or 0.25 inches per foot). Upon being installed, the waffle underside of the tray 10 eliminates deflection when weight is placed upon the tray 10.

Although the tray 10 has a fall to the receptor 12 sufficient to allow water to quickly drain, it maintains a thin profile. This profile allows it to be installed on top of structural flooring members, thus eliminating the need to modify an existing floor system, such as by lowering or cutting into the floor supports. The modification of existing floor supports may cause structural damage to the floors, adds time to installation of a shower, and increases the opportunity for mistakes in installation. The tray 10 may be used in structures comprising traditional wood joists, prefabricated wood joists, engineered trusses, or slab on grade concrete foundations. It may also be installed in concrete floors utilizing tension cables when measures are taken into account to avoid cables during installation.

Figure 13:
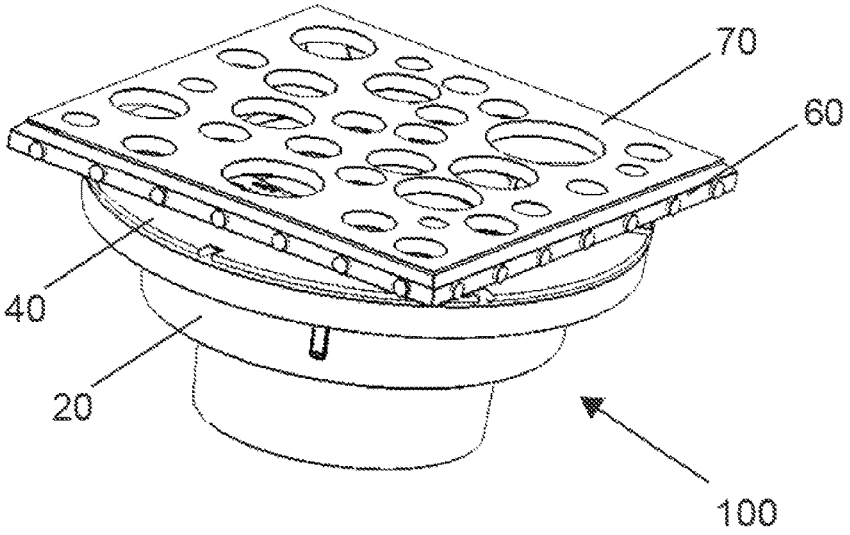
FIG. 13 provides a perspective view of an embodiment of an assembled drain assembly.
Figure 14:
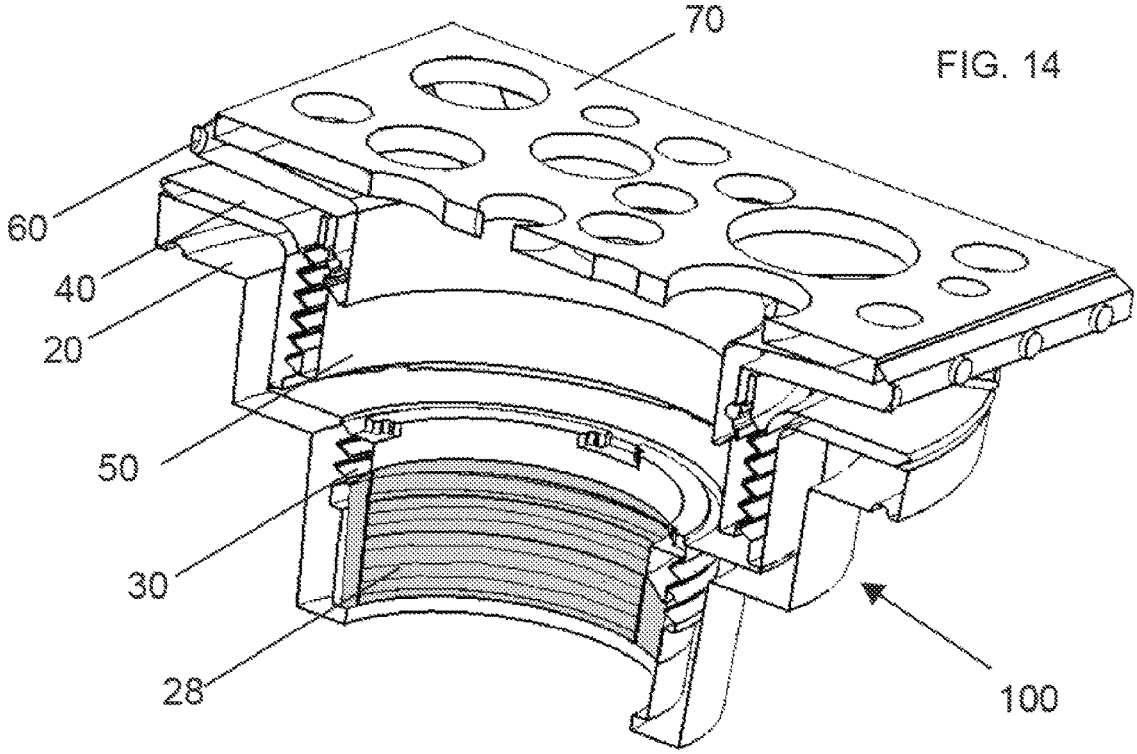
FIG. 14 provides a cutaway view of the assembly depicted in FIG. 13.

The receptor 12 is located in a central area of the tray 10. The receptor 12 incorporates at least one step for retaining the drain assembly 100 (see FIGS. 13-14). The receptor 12 as shown in the depicted embodiment comprises two steps and may further comprises screw receiving holes 16, 16', 16" and a cup engagement tab receiver 14.

Because the tray 10 is curbless, the tray 10 may be easily cut down to accommodate smaller shower designs. For example, it may be manufactured to measure 59.5 inches by 47.5 inches, a standard size for a larger shower, and be designed so that it may be cut down to 48.0 inches by 36.0 inches, a standard size for a smaller shower.

Some embodiments incorporate a textured surface for the top side of the tray 10, which may allow for the creation of a stronger mechanical bond between our tray and waterproofing materials used in installation.

In some embodiments, the tray 10 may be manufactured to incorporate cut lines and screw dimples into the top side of the tray 10 to ease installation. The cut lines match with strategically placed supports on the underside of the tray to ensure a solid installation. The screw dimples on the top side of the tray 10 may be strategically located to match up with a thickened area on the underside of the tray. This thickened area prevents screws used to secure the tray 10 to the floor's framing elements from breaking through the tray 10 before becoming fully installed.

A non-exclusive example of a method of installing an embodiment of the invention follows. Language such as "should" is horatory and not mandatory, and is not to be interpreted as limiting the scope of the invention or ruling out other methods of carrying out the invention.

Prior to installing the tray 10 in a room having a wooden subfloor and framing, the subfloor where the tray 10 is to be installed is removed. Next, it may be advisable to frame the area underneath the tray 10 such that blocks, such as plywood pieces, are installed between the joists or trusses of the floor's structural system to provide additional support to the area. A new subfloor, which may be level with the top of the floor's structural system, may then be installed over the framing elements with an opening in the center section of the shower area where the receptor 12 shall be located. The tray 10 may then be set into position. Any adjustments may then be made to ensure level installation of the tray 10 while making sure the bottom of the receptor 12 is not resting on a block, joist, truss, or other framing element.

Once this has been accomplished, a construction adhesive, such as a latex modified thinset or other mortar appropriate to secure, may be applied to the area beneath the tray 10. The tray 10, preferably with the drain assembly cup 20 (later described) already installed, may then be set into place on top of the adhesive to be secured to the replacement subfloor. The tray 10 may be further secured to the framing elements using, for example, screws around the perimeter of the tray 10.

The tray 10 may be manufactured from any of a variety of materials, including relatively lightweight but strong materials that are substantially impervious to water. Non-exclusive examples of materials from which the tray 10 may be manufactured include acrylic plastic, ABS or PVC plastic, or fiberglass.

Those skilled in the art will appreciate that other methods of installation may also be appropriate, whether the flooring structure is wooden, concrete, or some other material or combination of materials.

B. Drain Assembly

As may be seen in FIGS. 4-15, an embodiment of the inventive drain assembly 100 comprises a cup 20, lock ring 30, clamping flange 40, adjuster 50, grate retainer 60, and grate 70. This drain assembly 100 provides an easy to install, watertight drain for the inventive system. The embodiment of the drain assembly 100 as depicted in FIGS. 3-14 is compatible with a 2 inch pipe made of PVC plastic. With the use of a corresponding gasket, the assembly 100 may be further compatible with 2 inch ABS plastic, copper, or cast iron pipes by purchasing and using the corresponding rubber drain gasket. The addition of a drain coupling may allow the assembly 100 to be compatible with other types and sizes of pipes as well. The embodiment of the drain assembly 100 is further described below both as to its structure and in association with a non-exclusive example of an installation method. Again, language such as "should" is horatory and not mandatory and is not to be interpreted as limiting the scope of the invention or ruling out other methods of carrying out the invention.

The cup 20 is shown in detail in FIGS. 4-6. The cup 20 in the depicted embodiment is a stepped fitting with a lower threaded section 21, for securing the drainage pipe to the drain assembly 100 (further described below) and an upper section 23 for securing the clamping flange 40 (described below) to the cup 20. The cup 20 may further comprise a cup engagement tab 22 that protrudes below the underside of the cup 20, providing a means for aligning the cup 20 with the tab receiver 14 of the receptor 12 and for aligning the engagement tab 46 of the clamping flange 40 (described below). The cup 20 may comprise a plurality of mounting screw holes 24, 24', 24", which may be utilized in securing the cup 20 to the receptor 12 using a plurality of screws 25, 25', 25". The cup 20 may further comprise a plurality of clamping flange mounting screw holes 26, 26', 26", also used in installing the clamping flange 40.

The cup 20 may be installed by securing it to the receptor 12 of the shower tray 10. A seal, such as a gasket or an o-ring, may be placed between the receptor 12 and cup 20 to provide a watertight seal. In addition or in the alternative, the underside surface of the cup 20 coming into contact with the receptor 12 may be coated with a sealant, such as silicone or caulk. The cup 20 may be set into the receptor 12 and rotated until the engagement tab 22 of the cup 20 fits into the engagement tab receiver 13 (see FIG. 14) of the receptor 12. Use of the engagement tab 22 and receiver 13 ensures that the cup screw holes 24, 24', 24" will be properly aligned for installing the screws 25, 25', 25" through them and into the screw holes of the receptor 12.

Upon securing the tray 10 to the framing elements, the cup 20 fits securely to a drainage pipe. An adapter, such as a gasket 28 or drain adapter (not shown), may be installed between the cup 20 and a drainage pipe (not shown) to form a watertight seal. Drain adapters may take various forms depending on the type of pipe that is to be attached to the shower system. It may be advisable to use a suitable lubricant to aid in placement of the gasket 28. It may also be advisable to use watertight adhesive or sealant, such as latex caulk, between the cup 20 and the drain pipe or the drain adapter. It may further be advisable to utilize a secondary method of securing a drain adapter to the cup 20 such as by screwing the adapter to the cup 20. At this point, the tray 10, the perimeter around the tray 10, and the lower portion of the shower walls may be prepared for the installation of a waterproofing compound, such as a waterproofing membrane, over a waterproofing fabric, or a waterproof sheet membrane. After inspecting and testing for water tightness, selected flooring, such as tile, may be installed.

Figure 7:
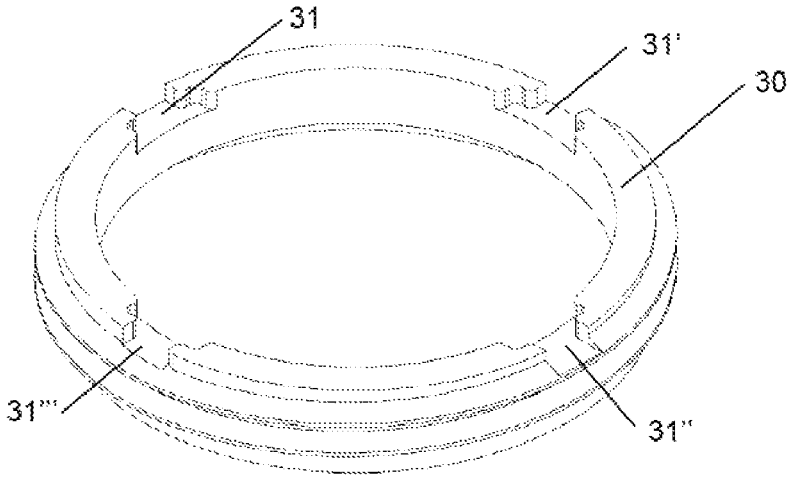
FIG. 7 depicts an embodiment of a lock ring configured for use with the cup depicted in FIG. 4.
Figure 8:
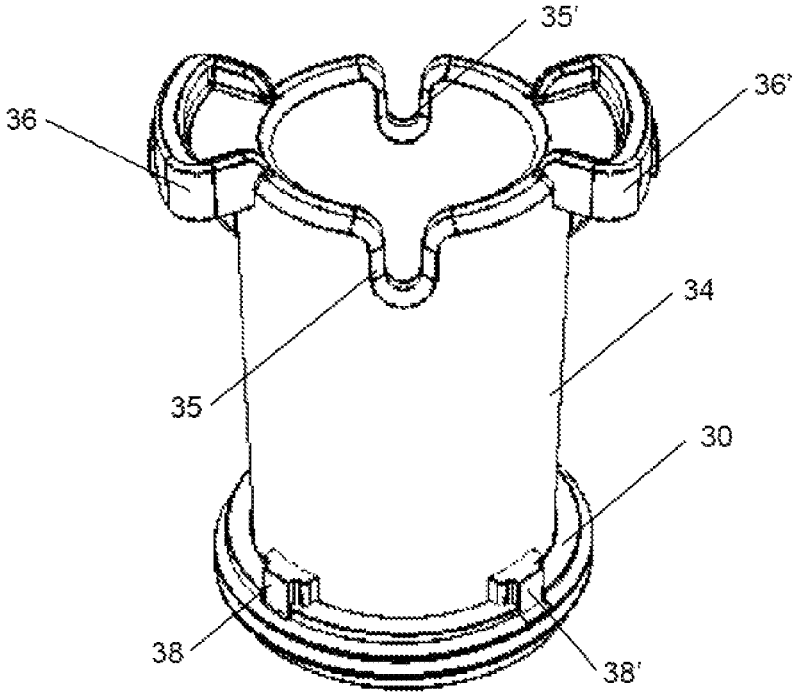
FIG. 8 shows a perspective view of an embodiment of a lock ring tightening tool engaged with a lock ring as shown in FIG. 7.
Figure 9:
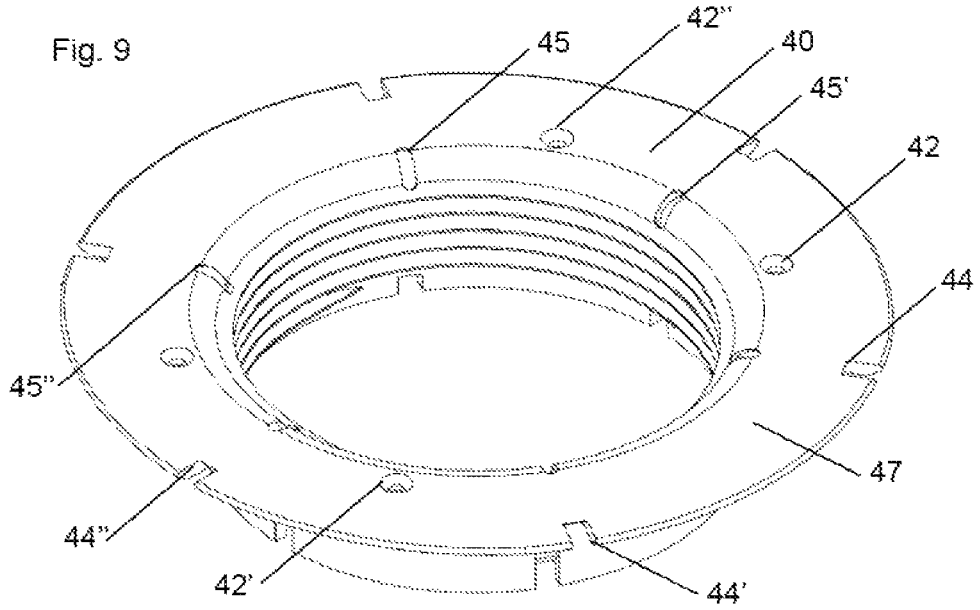
FIG. 9 provides a perspective view of an embodiment of a drain assembly clamping flange.
Figure 10:
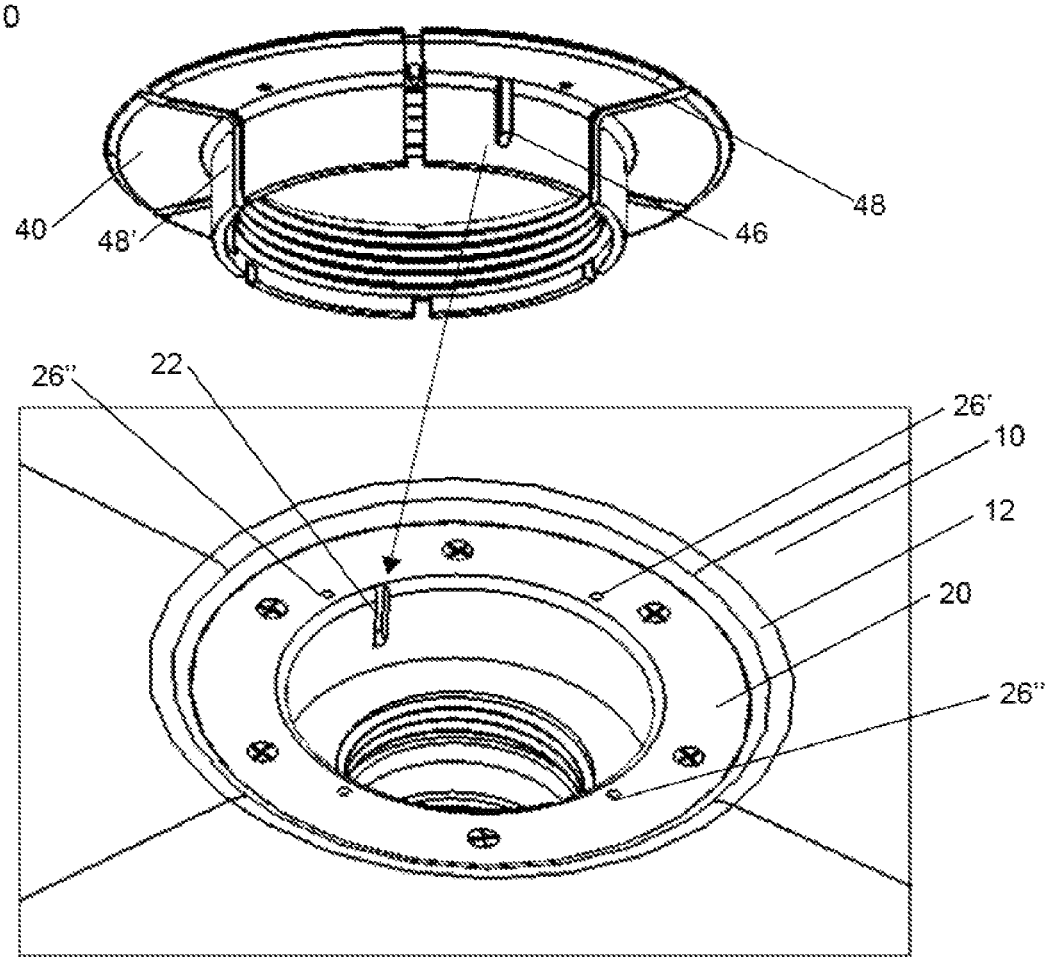
FIG. 10 depicts a side perspective view of the clamping flange depicted in FIG. 9 and a top perspective view of the cup depicted in FIG. 4 as installed in a shower tray.
Figure 11:
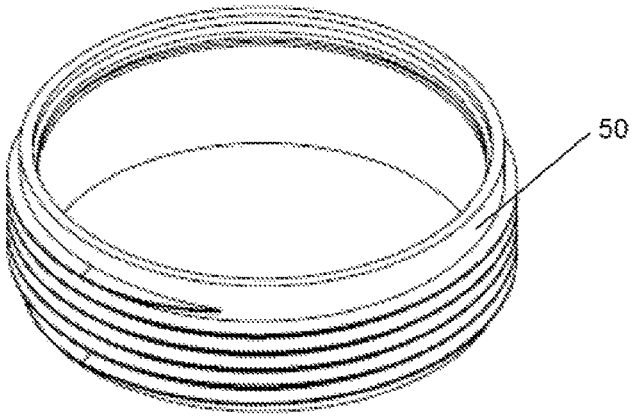
FIG. 11 depicts an embodiment of an adjuster configured for use with the clamping flange depicted in FIG. 9.
Figure 12:
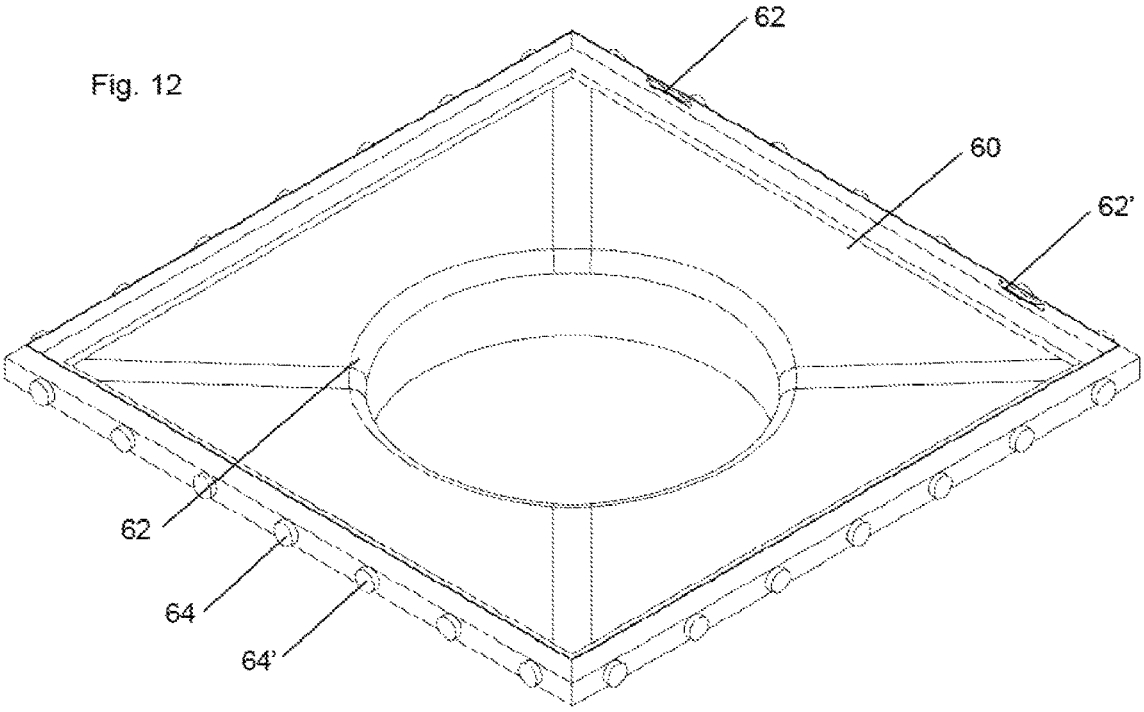
FIG. 12 depicts a perspective view of an embodiment of a grate retainer.
Figure 15:
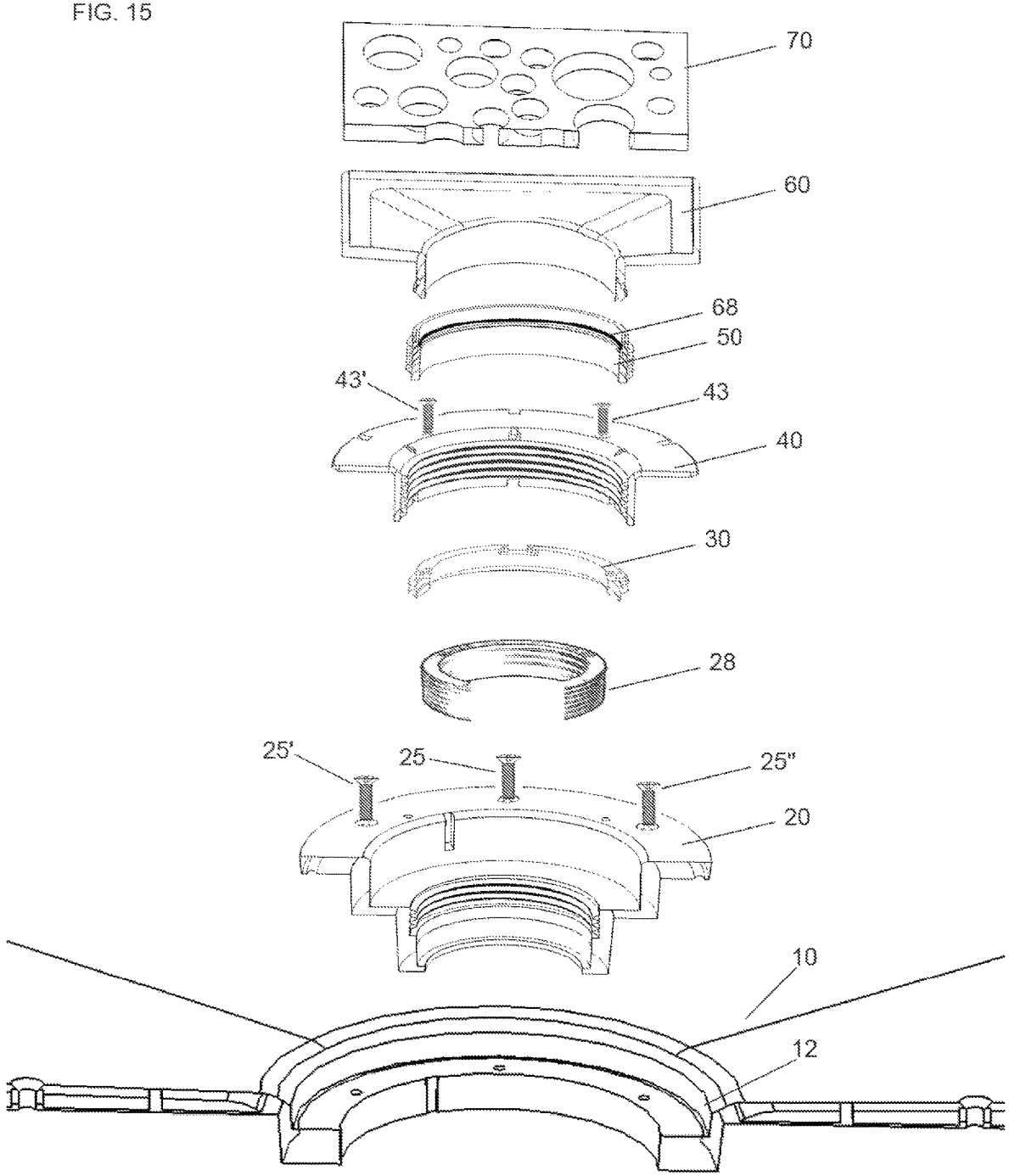
FIG. 15 shows a cutaway, exploded view of the assembly depicted in FIG. 13.

As shown in the depicted embodiment, a lock ring 30 and drain gasket 28 provide a watertight seal between the cup 20 and drainage pipe (not shown) without the use of caulk or other sealant, thereby providing for faster and more reliable installation. FIGS. 7 and 8 show an embodiment of a lock ring 30 and lock ring tightening tool 34. The embodiment of the lock ring 30 as shown comprises a rubber gasket with optional tightening tab receivers 31, 31', 31", 31'". The drain gasket 28 as depicted in FIG. 15 comprises a standard rubber gasket.

The applicant has devised an inventive multipurpose tightening tool, an embodiment of which is depicted as tightening tool 34, to assist in the installation process of the drain assembly 100. In the depicted embodiment, tightening tool 34 is cylindrical in shape and has two slots 35, 35' formed in the wall of the shaft at a first end thereof, each slot being substantially opposite the other slot; two handles 36, 36' extending outward from the outer surface of the wall substantially adjacent the first end of the shaft, each handle being substantially opposite the other handle; helical threads along the outer surface at the second end thereof, the helical threads being configured to engage the drain gasket lock ring 30; and preferably at least three tabs (two of which, 38, 38' are shown) located substantially equidistant around the circumference of the outer wall of the shaft adjacent the helical threads, the tabs being configured to engage the tab receivers 31, 31', 31", 31'" of drain gasket lock ring 30. The inventive tightening tool can be helpful in installation of the drain assembly, for example when used to install the cup 20, gasket 28, and lock ring 30 as described hereafter. Using the inventive tightening tool speeds the installation process and, because of its unique configuration, the inventive tightening tool is unlikely to become lost or to fall into an open drain pipe during the installation process, thus avoiding a common problem of existing installation tools.

After installing the cup 20 in the tray 10 and securing the tray 10 to the floor, a gasket 28 (see FIG. 15) may be set inside the threaded section 21 of the cup 20. The tightening tool 34 may be used to position and press into place the gasket 28 so that it is fully seated in the lower threaded section 21 (see FIGS. 4-6). The tightening tool 34 may then be used to seat the lock ring 30 in the upper portion 23 of the cup 20 so that it is frictionally engaged with the interior surface of the cup 20. Once the lock ring 30 has been set in place, the tool 34 may be used by grasping the handles 36, 36' or the upper area of the tool 34, aligning the tightening tab receivers 31, 31', 31", 31'" with the tightening tabs 38, 38', and firmly pressing down on the handles 36, 36' or the top edge of the tool 34. In the alternative, the tool 34 may be used by inserting a substantially rigid elongated member into the slots 35, 35' and using the elongated member to press or twist the tool 34 to align the tightening tab receivers 31, 31', 31", 31'" with the tightening tabs 38, 38'.

At this point, any waterproofing steps may be completed. For example, the area surrounding the tray 10 may be covered with a waterproofing compound, such as a waterproofing membrane, over a waterproofing fabric, or a waterproof sheet membrane may be used. The seams at the floor and corners may be taped and then an additional waterproofing layer may be applied over the entire shower floor area, including overtop the shower tray 10.

Once the waterproofing is complete, a circular opening may be cut into the waterproofing materials at the site of the drain assembly 100. As may be seen in FIGS. 9-10, the clamping flange 40 may then be installed. The clamping flange 40 comprises a plurality of screw holes 42, 42', 42", a plurality of outer weep holes 44, 44', 44", a plurality of inner weep holes 45, 45', 45", and a clamping flange engagement tab 46. These inner and outer weep holes 44, 44', 44", 45, 45', 45" align with small drain channels 48, 48' located on the bottom and side wall of the clamping flange 40. These channels 48, 48' continues down the wall of the clamping flange 40 and terminates just above the bottom flange of the cup 20. This drainage path allows any water that penetrates the flooring or grout areas to drain into the drainage pipe.

To install the clamping flange 40, the clamping flange 40 is set into the cup 20 and turned until the engagement tab 46 is aligned with the cup engagement tab 22. This alignment of the tabs 22, 46 provides a desirable alignment of the clamping flange mounting screw holes 26, 26', 26" of the cup 20 and the clamping flange mounting screw holes 42, 42', 42" of the clamping flange 40. In order to achieve a watertight seal, the waterproofing materials may be cut such that they fit under the outer edge of the clamping flange 40. When screws are inserted and secured in the screw holes 26, 26', 26" and through screw holes 42, 42', 42", the waterproofing materials are pressed between the top rim 27 of the cup 20 and the top rim 47 of the clamping flange 40.

The drain assembly 100 further comprises a three piece strainer system consisting of an adjuster 50, grate retainer 60, and grate 70, which are shown in FIGS. 11-14. The adjuster 50 may be threaded into the clamping flange 40 and serves to receive and hold in place the grate retainer 60. The grate retainer 60, in turn, secures the grate 60. The grate retainer 60 may comprise a small channel 61 within which an o-ring 68 (see FIG. 15) or other seal may be placed. Such a seal may assist in mating the adjuster 50 and grate retainer 60 and also aid in a watertight seal between the pieces should the attached drainage system ever back up.

This three piece system is particularly useful in that it allows for lowering the grate retainer 60 after the shower flooring has been installed. In the event that the strainer has to be lowered during floor installation, the grate retainer 60 may be disengaged from the adjuster 50, the adjuster 50 may be screwed down to provide a lower profile, and the grate retainer 60 may be re-installed.

The grate 70 and grate retainer 60 may further comprise some means for connecting the two such that the grate 70 will be held in place but may be removed for cleaning. For example, in the embodiment depicted in FIG. 12, the grate retainer 60 may have a plurality of tabs 62, 62' which pair with openings in the underside of the grate 70 (not shown).

The grate retainer may further comprise tile tabs 64, 64' around its perimeter to ensure an equal tile joint distance around the retainer 60 where the edges come into contact with tile.

Following the complete installation of the drain assembly 100, flooring for the shower area, such as tile or vinyl, may then be installed. Should it be determined that the grate 70 and grate retainer 60 were initially installed at the incorrect height, they may be removed and reinstalled at the correct height.

The foregoing details are exemplary only. Other modifications that might be contemplated by those of skill in the art are within the scope of this invention, and are not limited by the examples illustrated herein.

What is claimed is:

1. A level entry shower system comprising a shower tray and drain assembly, said shower tray comprising a stepped upper surface and a receptor, said receptor having at least one step to receive said drain assembly, said drain assembly comprising a cup for securing the drain assembly to the receptor and to a drainage pipe, a clamping flange for securing a waterproof floor covering between the clamping flange and the cup, at least one adapter for providing a watertight seal between the cup and drainage pipe, a grate, a grate retainer for securing the grate, an adjuster for adjustably securing the grate retainer to the clamping flange, and a plurality of threaded fasteners for securing the cup to the receptor, the receptor further comprises pre-formed holes configured to fit said threaded fasteners, and the cup further comprises pre-formed holes configured to fit said threaded fasteners.

2. The level entry shower system of claim 1 in which the tray further comprises an underside having a waffle grid.

3. The level entry shower system of claim 1 in which the receptor comprises at least two steps: a lower step for receiving the cup and an upper step for receiving the clamping flange.

4. The level entry shower system of claim 1 in which the receptor further comprises a engagement tab receiver and the cup further comprises a engagement tab for aligning the cup to the receptor.

5. The level entry shower system of claim 1 further comprising a gasket configured to fit between the receptor and the cup and to form a seal there between when so fitted.

6. The level entry shower system of claim 1 in which the cup further comprises an upper step and a lower step, said lower step configured to receive the clamping flange and said upper step configured to receive the grate retainer.

7. The level entry shower system of claim 6 comprising a first and second gasket configured to provide a watertight seal between the cup and the drainage pipe, the first gasket configured to fit inside the lower step and the second gasket configured to fit inside the upper step.

8. The level entry shower system of claim 1 in which the assembly further comprises a plurality of threaded fasteners for securing the clamping flange to the cup, the cup further comprises pre-formed holes configured to fit said threaded fasteners, and the clamping flange further comprises pre-formed holes configured to fit said threaded fasteners.

9. The level entry shower system of claim 1 in which the cup further comprises an engagement tab receiver and the clamping flange further comprises an engagement tab for aligning the clamping flange to the cup.

10. The level entry shower system of claim 1 in which the clamping flange further comprises a plurality of weep holes aligned with at least one channel providing a drainage path into the drainage pipe.

11. The level entry shower system of claim 1 in which the grate retainer further comprises a means for removably securing the grate.

12. The level entry shower system of claim 11 in which the grate retainer further comprises an inside edge and a plurality of tabs around the inside edge and the grate further comprises a plurality of tab receivers to releasably secure the grate to the grate retainer.

13. The level entry shower system of claim 1 in which the grate retainer further comprises an outside top edge, around which a plurality of substantially equally sized tile tabs are formed to provide substantially consistently spaced installation of tiles around the outside top edge of the retainer.

* * * * *